US007555798B2

(12) United States Patent
Kim et al.

(10) Patent No.: US 7,555,798 B2
(45) Date of Patent: Jul. 7, 2009

(54) WASHER AND WASHING CYCLE CONTROL METHOD THEREOF

(75) Inventors: Seong Sik Kim, Seoul (KR); Kweon Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 520 days.

(21) Appl. No.: 10/963,593

(22) Filed: Oct. 14, 2004

(65) Prior Publication Data

US 2005/0086742 A1 Apr. 28, 2005

(30) Foreign Application Priority Data

Oct. 23, 2003 (KR) ..... 10-2003-0074062

(51) Int. Cl.
*D06F 35/00* (2006.01)

(52) U.S. Cl. ..... 8/158; 68/12.04

(58) Field of Classification Search ..... 68/12.04; 8/158

See application file for complete search history.

(56) References Cited

U.S. PATENT DOCUMENTS

| | | | | |
|---|---|---|---|---|
| 3,638,090 | A * | 1/1972 | Ebbinge | 388/830 |
| 4,556,827 | A * | 12/1985 | Erdman | 318/254 |
| 5,200,684 | A * | 4/1993 | Fisher | 318/809 |

FOREIGN PATENT DOCUMENTS

| | | | |
|---|---|---|---|
| CN | 1199787 | | 11/1998 |
| EP | 0-536-542 | A1 | 4/1993 |
| EP | 1-201-811 | | 5/2002 |
| EP | 1-428-925 | A1 | 6/2004 |
| GB | 2-325-245 | A | 11/1998 |

* cited by examiner

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

The present invention provides a washer and washing cycle control method thereof, by which a laundry amount of a laundry can be measured prior to a water supply despite a dry state of the laundry and by which the waste of power consumption and unnecessary use of water can be prevented. The present invention includes a drum holding a laundry therein, a motor rotating the drum, and a control unit executing a sub-routine for measuring a laundry amount of the laundry prior to a water supply to the drum. And, the sub-routine includes the steps of applying a ramp drive voltage to the motor during an acceleration section to measure a motor RPM amount and a drive voltage amount during the acceleration section, stopping supplying the ramp drive voltage to the motor to measure a motor RPM amount of a deceleration section, and measuring a laundry amount of the laundry using the motor RPM amount of acceleration section, the drive voltage amount of the acceleration section, and the motor RPM amount of the deceleration section.

6 Claims, 7 Drawing Sheets

WASHER AND WASHING CYCLE CONTROL METHOD THEREOF

This application claims the benefit of Korean Patent Application No. 10-2003-0074062, filed on Oct. 23, 2003, which is hereby incorporated by reference as if fully set forth herein.

BACKGROUND OF THE INVENTION

1. Field of the Invention

The present invention relates to a washer and washing cycle control method thereof.

2. Discussion of the Related Art

Generally, a drum type washer has a configuration shown in FIG. 1 as follows.

Referring to FIG. 1, a tub 20 is fixed to an inside of a body 10. A drum 30 is rotatably installed within the tub 20 to be rotated by receiving a drive force of a BLDC (brushless direct current) motor 40 via belt 41. A plurality of baffles 31 are fixed to an inner circumference of the drum 30 to leave a predetermined distance from each other. And, the baffles 31 are operative in lifting a laundry upward within the drum 30.

A sensor hose 60 is connected to a bottom of the tub 20. And, a water level sensor 50 is provided to a tip of the sensor hose 60 to sense an amount of water supplied to the tub 20. The water level sensor 50 applies a signal of sensing the amount of water to a system control unit 70.

FIG. 2 is a block diagram of the system control unit 70 of the general drum type washer.

Referring to FIG. 2, the system control unit 70 consists of a converter 71 converting 220V AC voltage to DC voltage, an inverter unit 72 applying the DC voltage outputted from the converter 71 to the BLDC motor 40 as a power source according to a drive signal, a rotational speed sensing unit 73 sensing a rotational speed of the BLDC motor 40, a water level sensing unit 74 sensing a water level within the tub 20, a control unit 75 generating control signals according to various input signals of the water level sensing unit 74, the rotational speed sensing unit 73, and the like, and a gate drive unit 76 outputting drive signals according to the control signals outputted from the control unit 75.

A method of measuring a laundry amount in a drum type washer according to a related art is explained by referring to FIG. 3 and FIG. 4 as follows.

Referring to FIG. 3, once a washing cycle is initiated, water is supplied to the drum at a water level previously set up by a user.

The control unit 75 sends a gate drive control signal and a PWM (pulse width modulation) signal to drive the BLDC motor 40. In doing so, the control unit agitates the drum 40 in forward-to-reverse directions so that water can be evenly absorbed in the laundry.

After the water has been evenly absorbed in the laundry by agitating the drum 40 in the forward-to-reverse directions, the water level, as shown in FIG. 4, is lowered below the water level previously set up by the user.

If the water level is lowered below the previously set water level by the water absorption in the laundry, the control unit 75 decides whether a water re-supply is necessary.

If deciding that the water re-supply is necessary, the control unit 75 stops agitating the drum 30 in the forward-to-reverse directions. After having re-supplied water up to the previously set water level, the control unit 75 agitates the drum 30 again.

The control unit 75 repeatedly performs the above-explained procedure during a prescribed time t1 and counts the number of performing the water re-supply.

After the prescribed time t1 has passed, the control unit 75 decides the laundry amount of the laundry according to the counted number of performing the water re-supply. If the counted number is small, it is decided that the laundry amount is small. If the counted number is great, it is decided that the laundry amount is large.

A criteria of deciding the laundry amount according to the water re-supply number is determined via tests to be programmed in the control unit 75.

For instance, if the water re-supply number is smaller than '2', it is decided that the laundry amount of the laundry is smaller than 2 kg. If the water re-supply number is greater than '7', it is decided that the laundry amount of the laundry is greater than 5 kg.

However, the related art laundry amount deciding method is carried out in a manner of deciding the laundry amount using the water re-supply number after completion of supplying the water into the drum, whereby a washing time is fixed regardless of the laundry amount of the laundry as well as an amount of used water is almost identical.

Hence, a washing cycle time is unnecessarily taken so long as to waste power consumption. And, the amount of the used water is unnecessarily sufficient to waste water.

SUMMARY OF THE INVENTION

Accordingly, the present invention is directed to a washer and washing cycle control method thereof that substantially obviate one or more of the problems due to limitations and disadvantages of the related art.

An object of the present invention, which has been devised to solve the foregoing problem, lies in providing a washer and washing cycle control method thereof, by which a laundry amount of a laundry can be measured prior to a water supply despite a dry state of the laundry.

It is another object of the present invention to provide a washer and washing cycle control method thereof, by which the waste of power consumption and unnecessary use of water can be prevented.

The present invention is characterized in finding to use a motor RPM amount of an acceleration section, a motor RPM amount of a deceleration section, and a motor drive voltage amount applied during the acceleration time by accelerating to stop a rotation of a drum using a motor prior to a water supply. Thus, the present invention measures a laundry amount of the laundry.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, in a washer comprising a drum holding a laundry therein and a motor rotating the drum, there is provided a method of controlling a washing cycle, including the steps of applying a drive voltage to the motor during an acceleration section to measure a motor RPM amount and a drive voltage amount during the acceleration section before supplying water to the drum, stopping supplying the drive voltage to the motor to measure a motor RPM amount of a deceleration section, and measuring a laundry amount of the laundry using the motor RPM amount of acceleration section, the drive voltage amount of the acceleration section, and the motor RPM amount of the deceleration section.

In another aspect of the present invention, there is provided a washer including a drum holding a laundry therein, a motor rotating the drum, and a control unit executing a sub-routine for measuring a laundry amount of the laundry prior to a water supply to the drum, the sub-routine including the steps of applying a ramp drive voltage to the motor during an acceleration section to measure a motor RPM amount and a drive voltage amount during the acceleration section, stopping supplying the ramp drive voltage to the motor to measure a motor RPM amount of a deceleration section, and measuring a laundry amount of the laundry using the motor RPM amount of the acceleration section, the drive voltage amount of the acceleration section, and the motor RPM amount of the deceleration section.

Preferably, the laundry amount is found by 'area-A×Vref/Vdc+C×area-B/area-A' where A, B, Vref, Vdc, and C are the motor RPM amount of the acceleration section, the motor RPM amount of the deceleration section, a reference DC voltage, a DC drive voltage amount applied during the acceleration section, and a constant for weight, respectively.

Therefore, the laundry amount of the laundry is measured prior to supplying the water to the washer, whereby the power consumption for the laundry amount measurement and a used water amount can be considerably reduced.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 5:
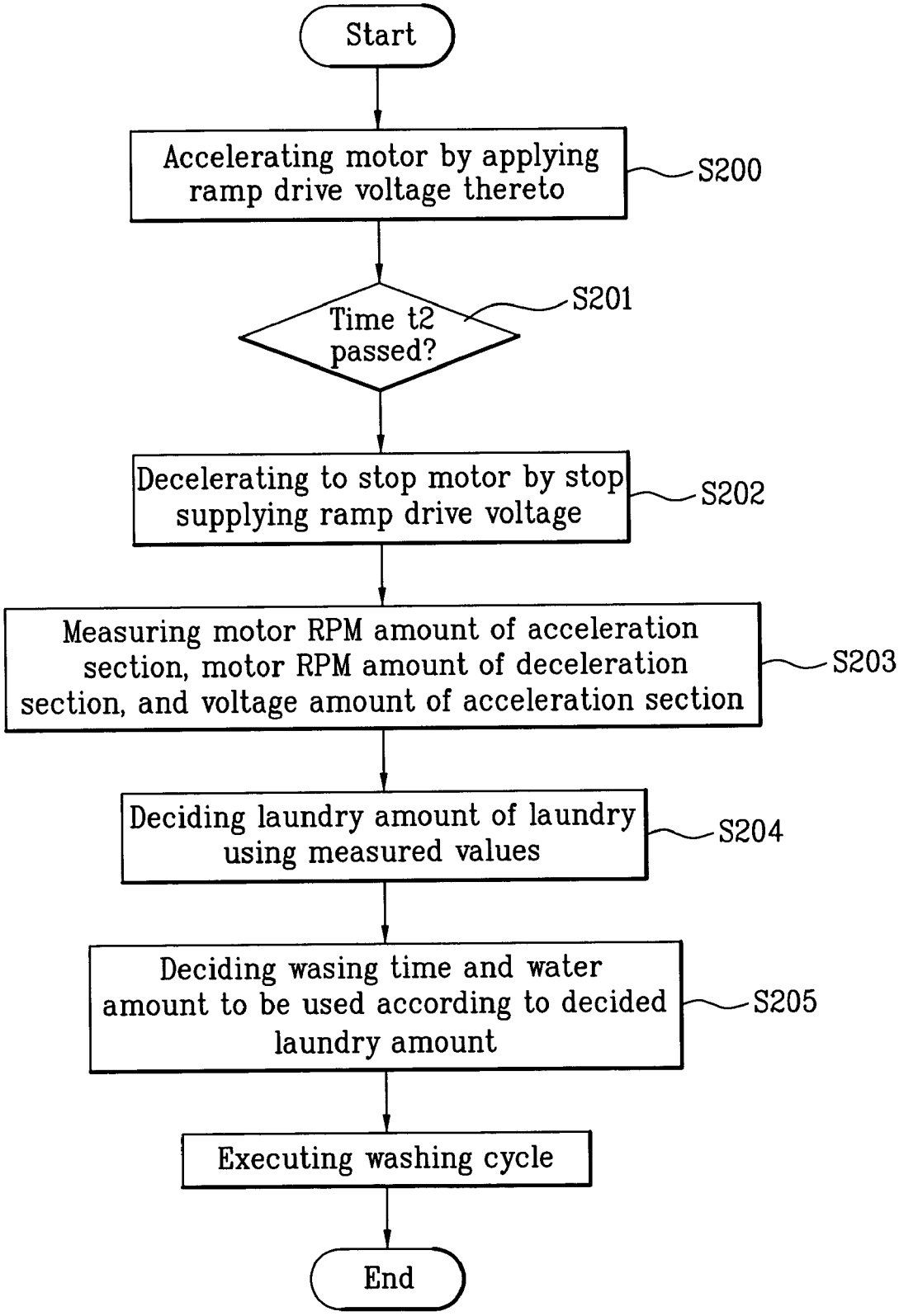
FIG. 5 is a flowchart of a sub-routine for measuring a laundry amount of a laundry in a drum type washer according to the present invention.
Figure 6A:
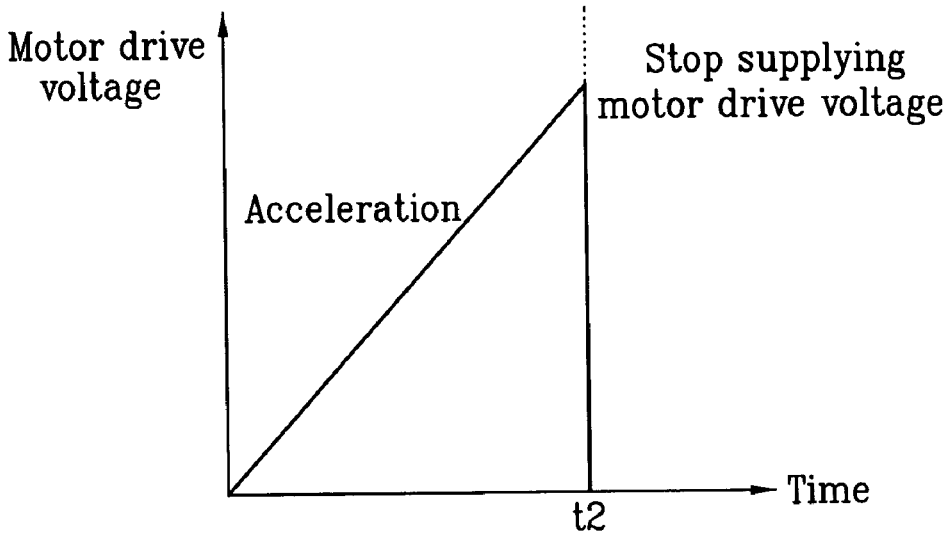
FIG. 6A and FIG. 6B are graphs of explaining a process of accelerating or stopping a rotation of a motor according to the present invention.
Figure 6B:
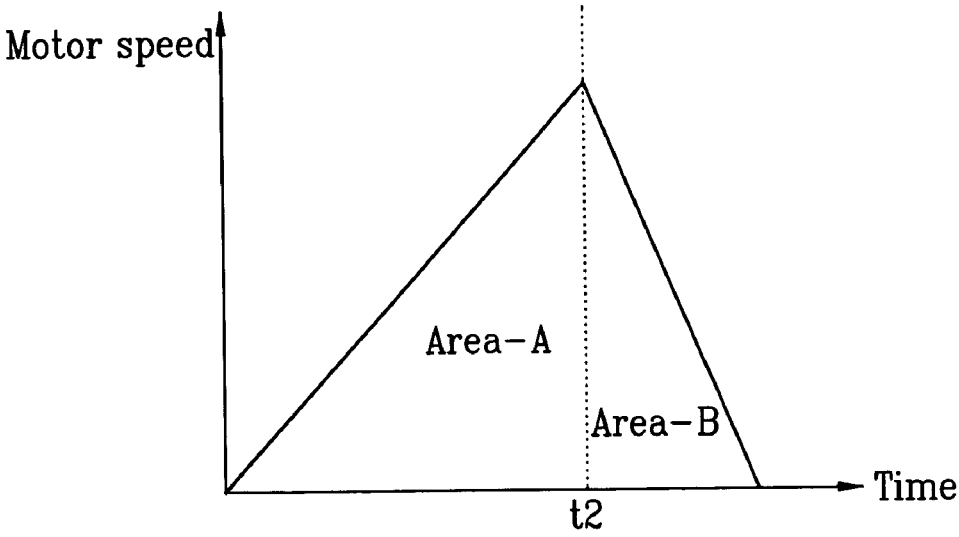
Figure 7:
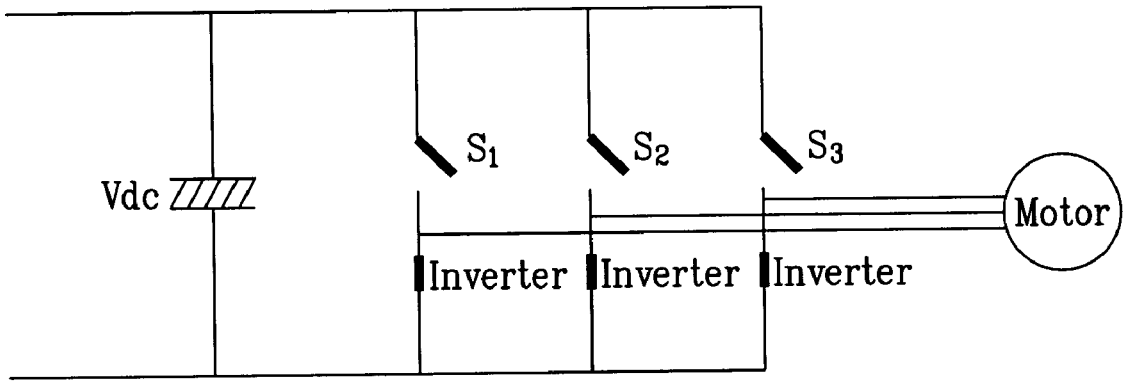
FIG. 7 is a diagram of a circuit for stopping supplying a drive voltage applied to a motor.

FIG. 5 is a flowchart of a sub-routine for measuring a laundry amount of a laundry in a drum type washer according to the present invention, FIG. 6A and FIG. 6B are graphs of explaining a process of accelerating or stopping a rotation of a motor according to the present invention, and FIG. 7 is a diagram of a circuit for stopping supplying a drive voltage applied to a motor.

First of all, a washer according to one embodiment of the present invention includes a drum holding a laundry therein, a motor rotating the drum, and a control unit executing a sub-routine for determining a laundry amount of the laundry prior to a water supply to the drum.

And, the sub-routine includes the steps of applying a ramp drive voltage to the motor during an acceleration section to measure an RPM amount of the motor and a drive voltage amount during the acceleration section, stopping supplying the ramp drive voltage to the motor to measure the RPM amount of the motor during a deceleration section, and measuring the laundry amount of the laundry using the RPM amount of the motor during the deceleration section.

The acceleration section lies between a start time point of supplying the drive voltage to the motor and an end time point of supplying the drive voltage to the motor. And, the deceleration section lies between the end time point of supplying the drive voltage and a rotation-stop time point of the motor.

Figure 1:
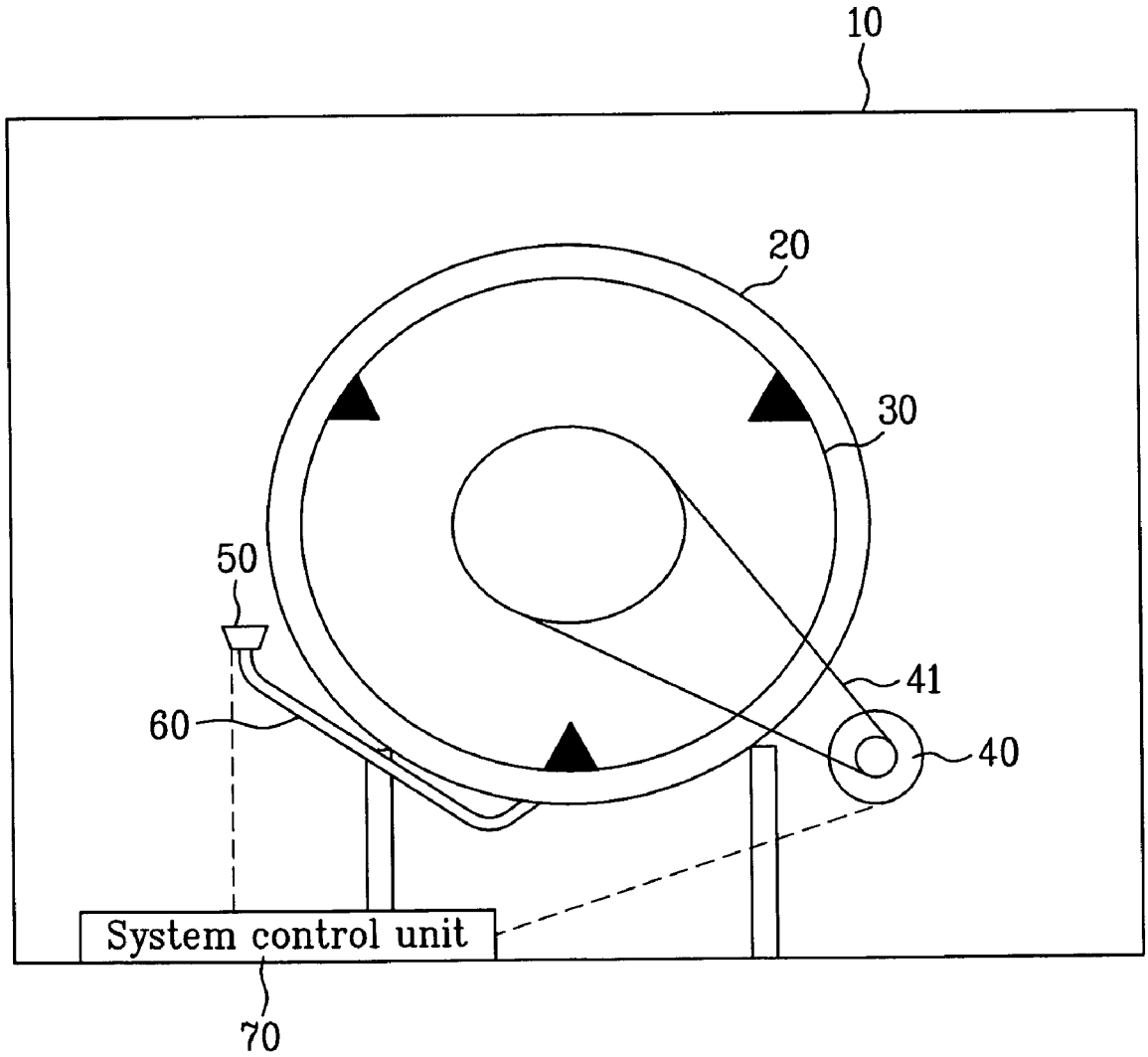
FIG. 1 Background Art
FIG. 1 is a cross-sectional diagram of a general drum type washer.
Figure 2:
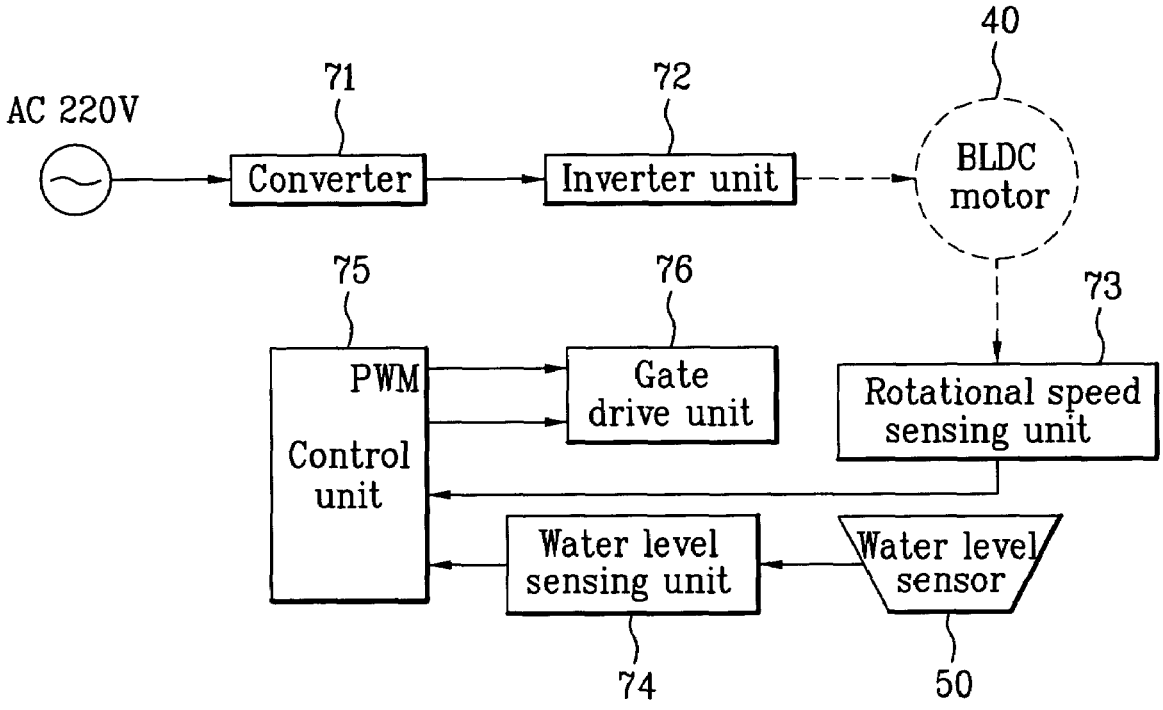
FIG. 2 Background Art
FIG. 2 is a block diagram of a control drive of a general drum type washer.
Figure 3:
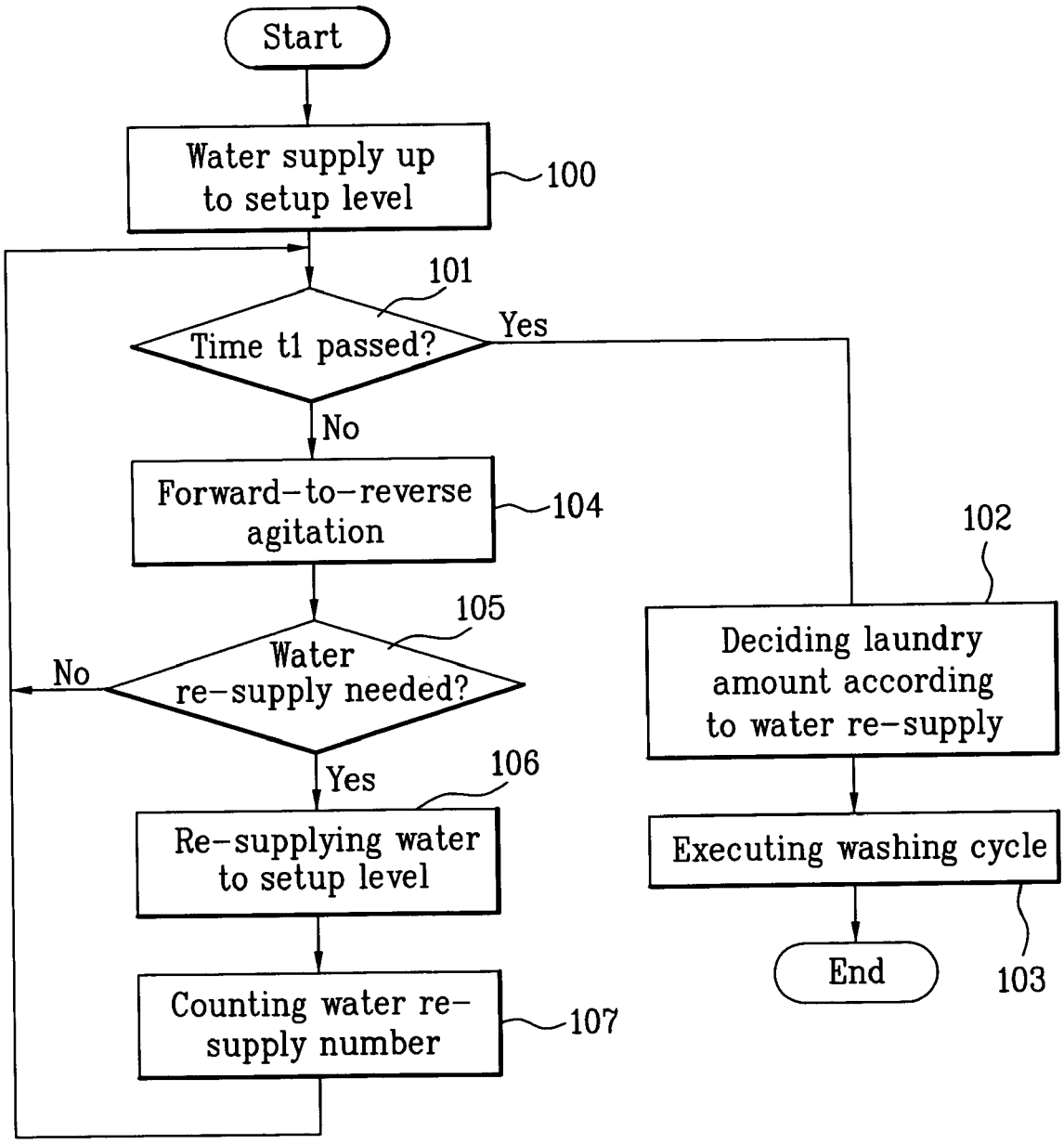
FIG. 3 Background Art
FIG. 3 is a flowchart of a sub-routine for measuring a laundry amount of a laundry in a drum type washer according to a related art.
Figure 4:
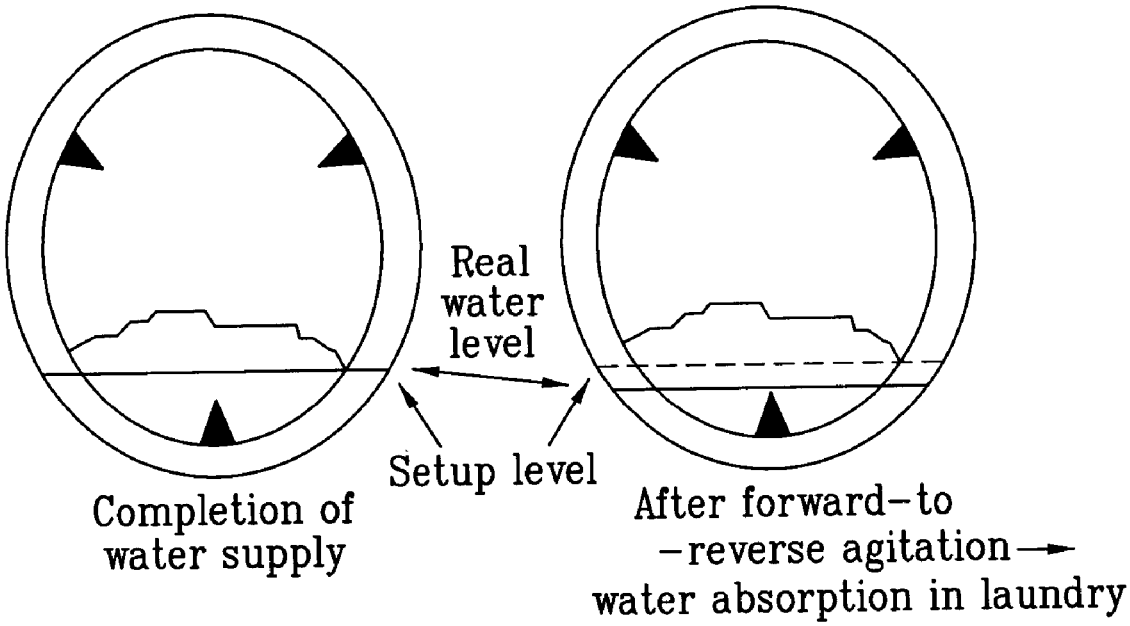
FIG. 4 Background Art
FIG. 4 is a cross-sectional diagram of a drum type washer for explaining a principle of measuring a laundry amount of a laundry in a drum type washer according to a related art.

Configurations of the drum type washer and the control drive are equivalent to those in FIG. 1 and FIG. 2, whereby their detailed explanation will be skipped in the following.

Yet, the control unit, which generates the various corresponding control signals according to various signals inputted from the water level sensing unit and the rotational speed sensing unit, measures the laundry amount of the dry laundry instead of determining the laundry amount of the laundry according to the water supply number in the related art method.

The control unit of the drum type washer accelerates a rotation of the motor by applying a ramp drive voltage to the motor during a prescribed time before supplying water to the drum and then short-circuits three-phase coils of the motor. Namely, the control unit stops the supply of the ramp drive voltage applied to the motor to decelerate the accelerated motor, thereby stopping the rotation of motor eventually.

Meanwhile, the control unit measures a motor RPM amount of the acceleration section, a motor RPM amount of the deceleration section, and the ramp drive voltage amount applied to the motor during the acceleration section. In the embodiment of the present invention, the motor is the three-phase coil type DC motor and the ramp drive voltage is DC voltage. Subsequently, the control unit enables to measure the laundry amount of the laundry which is in a dry state using the motor RPM amount of the acceleration section, the motor RPM amount of the deceleration section, and the ramp drive voltage amount applied to the motor during the acceleration section.

A function of measuring the laundry amount using the measure information will be explained later by referring to FIG. 6 and FIG. 7.

In performing the washing cycle in the drum type washer, the control unit, as shown in FIG. 5, preferentially measures the laundry amount of the laundry that is in the dry state before the water is supplied to the drum.

Namely, when a user puts the laundry in the drum of the drum type washer, the control unit controls the motor drive unit before supplying the water to the drum so that a DC voltage having a uniform slope, i.e., ramp drive voltage, to the motor to accelerate the rotation of the motor.

In doing so, the acceleration section is determined to lie between 2~5 seconds. Specifically, the acceleration section is determined to correspond to about two or three seconds in case of a small laundry, i.e., light load. And, the acceleration section is determined to correspond to about five seconds in case of a heavy load. As mentioned in the foregoing description, the acceleration section can be previously determined according to a kind or amount of the laundry appropriately.

After the acceleration section has passed, the control unit short-circuits the three-phase coils of the DC motor to decelerate the accelerated motor, thereby stopping the motor eventually.

During the acceleration and deceleration sections, the control unit measures the motor RPM amount of the acceleration section, the motor RPM amount of the deceleration section, and the ramp drive voltage applied to the motor during the acceleration section. For example, the motor RPM amounts of the acceleration and deceleration sections are found by '½ (Sm×As)' and '½ (Sm×Ds)', respectively, where 'As', 'Ds', and 'Sm' are the acceleration section, the deceleration section, and a maximum motor speed during the acceleration section, respectively. The control unit then measures the precise laundry amount of the laundry in the dry state using the measured information.

Meanwhile, the control unit determines the washing time and water amount for the washing cycle based on the measured laundry amount and then executes the washing cycle according to the determined washing time and water, In doing so, a DC ramp voltage, as shown in FIG. 6A, having a constant increase slope during a period of time 0~t2 is applied to the motor before the water is supplied to the drum type washer and then stops being supplied to the motor at a time point t2.

In FIG. 6B, the acceleration section, the motor RPM amount of the acceleration section, the deceleration section, and the motor RPM amount of the deceleration section are indicated by 't2', 'area-A', 't3~t2, and 'area-B', respectively.

The control unit measures the laundry amount of the laundry using the motor RPM amount (area-A) of the acceleration section, the motor RPM amount (area-B) of the deceleration section, and the DC ramp voltage Vdc applied to the motor during the acceleration section.

And, the laundry amount can be found by Function 1 as follows.

$$\text{Laundry amount} = f(\text{area-}A, \text{area-}B, Vdc) \qquad \text{[Function 1]}$$

$$= \text{area-}A \times Vref / Vdc + C \times \text{area-}B / \text{area-}A$$

In Function 1, 'area-A×Vref/Vdc' means a voltage compensation because the area-A is affected by the laundry amount of the laundry and the DC drive voltage.

In Function 1, 'C×area-B/area-A' means an area compensation because the area-B is affected by the laundry amount of the laundry and the area-A.

In Function 1, the constant 'C' is considered as a weight for the 'area-A×Vref/Vdc' and 'Vref' is a DC reference voltage. In case of DC voltage, the 'Vref' is about 5V.

FIG. 7 shows a process of stopping a supply of the DC ramp drive voltage after the rotation of the DC motor has been accelerated by applying the DC ramp voltage during the prescribed time t2.

Referring to FIG. 7, the motor having been accelerated until the time t2 is decelerated to stop in a manner of short-circuiting the three-phase coils short-circuited by turning on the entire switches S1, S2, and S3 of inverters.

As mentioned in the foregoing description of the washer and control method thereof according to the embodiments of the present invention, the laundry amount of the laundry in the dry state is measured prior to supplying the water to the washer, whereby the washing time and the water amount can be appropriately determined. Moreover, the present invention enables to prevent the energy and water from being unnecessarily wasted.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. In a washer comprising a drum holding a laundry therein and a motor rotating the drum, a method of controlling a washing cycle, comprising the steps of:

applying a drive voltage to the motor during an acceleration section to measure a motor RPM amount and a drive voltage amount during the acceleration section before supplying water to the drum;

stopping supplying the drive voltage to the motor to measure a motor RPM amount of a deceleration section; and measuring a laundry amount of the laundry using the measured drive voltage amount, the motor RPM amount of acceleration section and the motor RPM amount of the deceleration section, wherein the motor is a three-phase coil type DC motor, and wherein the laundry amount is found by 'area-A×Vref/Vdc+C×area-B/area-A' where A, B, Vref, Vdc, and C are the motor RPM amount of the acceleration section, the motor RPM amount of the deceleration section, a reference DC voltage, a DC drive voltage amount applied during the acceleration section, and a constant for weight, respectively.

2. The method of claim 1, further comprising the step of determining a washing time and a water amount according to the measured laundry amount.

3. The method of claim 1, wherein the acceleration section lies between a start time point of supplying the drive voltage to the motor and an end time point of supplying the drive voltage to the motor and wherein the deceleration section lies between the end time point of supplying the drive voltage and a rotation-stop time point of the motor.

4. The method of claim 3, wherein the motor RPM amounts of the acceleration and deceleration sections are found by '½ (Sm×As)' and '½ (Sm×Ds)', respectively, where 'As', 'Ds', and 'Sm' are a time period of the acceleration section, a time period of the deceleration section, and a maximum motor speed during the acceleration section, respectively.

5. The method of claim 1, wherein the drive voltage is a ramp drive voltage having a slope increasing according to a time.

6. The method of claim 1, wherein the drive voltage stops being supplied to the motor to short-circuit the three-phase coil.

* * * * *